US006814925B1

(12) United States Patent
Jimenez

(10) Patent No.: US 6,814,925 B1
(45) Date of Patent: Nov. 9, 2004

(54) SMELTING FURNACE FOR MOLDING

(75) Inventor: Luis Cobos Jimenez, San Sebastian (ES)

(73) Assignee: Fundacion Inasmet (ES)

( * ) Notice: Subject to any disclaimer, the term of this patent is extended or adjusted under 35 U.S.C. 154(b) by 0 days.

(21) Appl. No.: 10/168,471

(22) PCT Filed: Jan. 21, 2002

(86) PCT No.: PCT/ES00/00023

§ 371 (c)(1),
(2), (4) Date: Jun. 14, 2002

(87) PCT Pub. No.: WO01/47656

PCT Pub. Date: Jul. 5, 2001

(30) Foreign Application Priority Data

Dec. 23, 1999 (ES) ..... 9902838

(51) Int. Cl.[7] ..... C21C 5/48
(52) U.S. Cl. ..... 266/239; 222/595; 164/309
(58) Field of Search ..... 266/239; 222/595; 164/309

(56) References Cited

U.S. PATENT DOCUMENTS 3,810,564 A * 5/1974 Allyn et al. ..... 222/595

FOREIGN PATENT DOCUMENTS

EP 0916435 A1 * 5/1999

* cited by examiner

*Primary Examiner*—Scott Kastler
(74) *Attorney, Agent, or Firm*—Muserlian, Lucas and Mercanti

(57) ABSTRACT

New melt furnace for casting, of the kind that have a loading nozzle that connects to a liquid metal storage tank and from where an outlet nozzle opens out in the feed runner of the casts, and where, between the liquid metal storage tank and the feed runner of the casts, there is an additional heating chamber by means of a thermal plasma torch and a retaining wall submerged at least partially in the liquid metal between the additional heating chamber and the feed runner of the casts.

For application in metallurgic foundry.

8 Claims, 2 Drawing Sheets

SMELTING FURNACE FOR MOLDING

This application is a 371 of PCT/ES00/00023 filed Jan. 21, 2000.

Currently, melt furnaces for automatic casting have been heard of where the liquid metal is heated in the tank by means of inducers placed on the base or on the sides or by means of plasma as in the EP0916435.

The melt from the runner must be strictly adjusted to the manufacturing order, which depends on the nature of the part to be melted.

This nature means that the metal in the runner must be at a pre-established and variable temperature($\theta$) for each type of part, admitting small margins ($\theta+\Delta$) in the temperature variations with respect to the pre-established temperature, these margins also varying for each part to be melted.

As a result, and within the rate of the manufacturing orders, the temperature ($\theta$) in the runner must vary and therefore, the temperature of the liquid metal in the runner is made to vary, which gives rise, due to its great mass, to great inertias, little flexibility and great energy expenditure.

The applicant has solved the aforementioned problem creating an additional chamber between the tank and the runner and arranging for the heating of this additional chamber to be by plasma.

This arrangement means that when the temperature ($\theta$) of the liquid metal in the runner has to be increased due to needs of the part to be cast or others, the mass of the liquid metal to be heated is small (only the additional chamber mass) and thanks to the plasma, the heating is practically instantaneous, with which the flexibility of the system increases enormously, adapting immediately to the needs, representing a great energy saving.

To improve the furnace even more the invention foresees that the additional chamber will have connection downstream from the runner, that is, towards the nozzle outlet of the storage tank.

This additional chamber means that the current heating means of the tank such as the inducer or plasma are unnecessary, although it can perfectly be added to them.

It will be understood that if the heating means of the tank are removed, the volume (V) of the additional chamber will be greater than if it is decided to maintain them and use them when desired, in the first case, the volume (V) of the additional chamber being able to be between 5 and 10% of the total working volume (Vt) of the furnace: $5\% \ Vt \leqq V \leqq 10\% \ Vt$, and in the second case between 15 and 20%, that is, $15\% \ Vt \leqq V \leqq 20\% \ Vt$, these amounts being approximate and experimental.

In order to understand the object of this invention better, a preferential way of practical execution is illustrated on the drawings, subject to accessory changes that take nothing away from its fundamentals.

Figure 1:
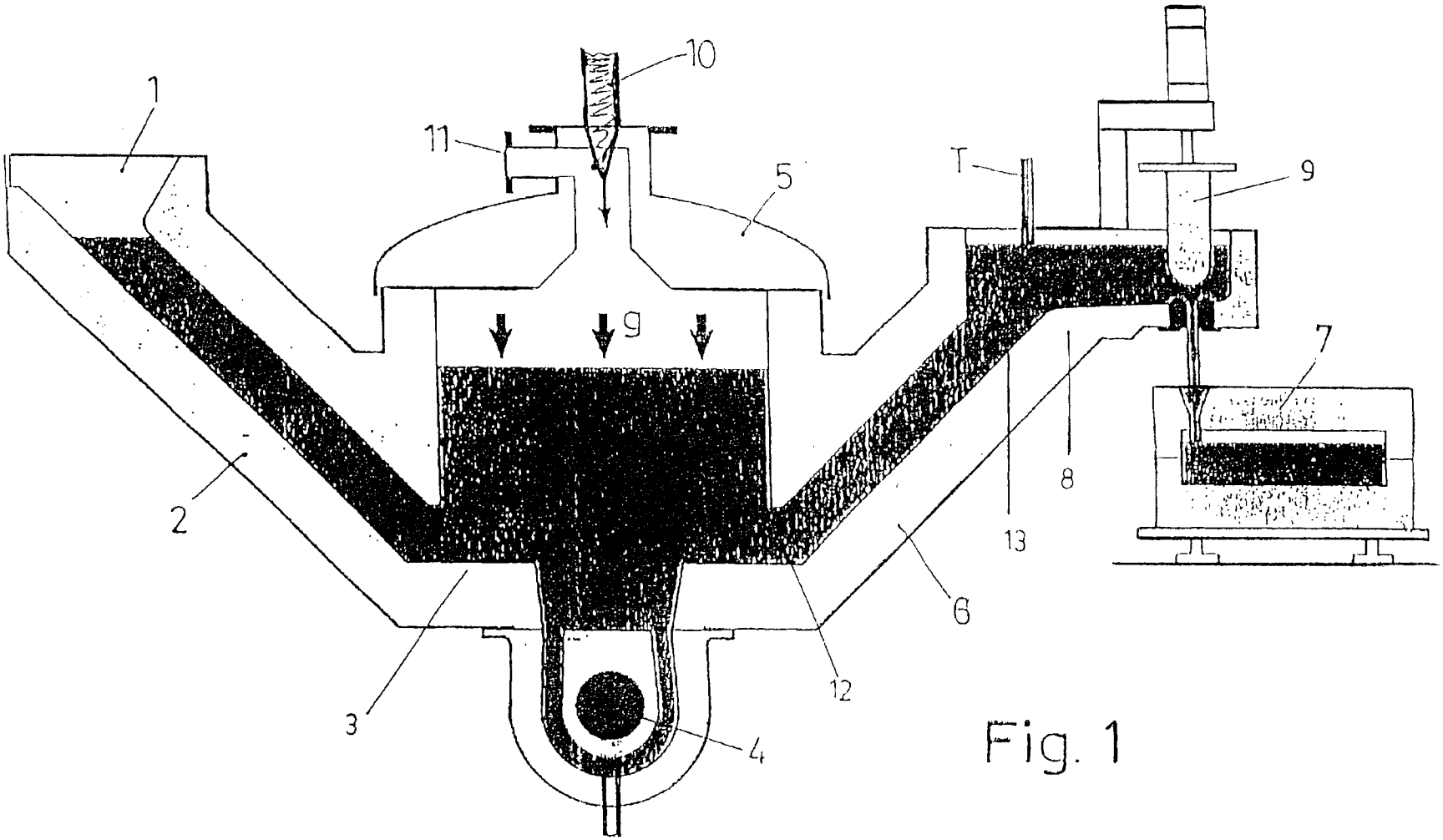
FIG. 1 is the schematic representation of an already known melt furnace.

In FIG. 1, the following are arranged in traditional fashion:

1.—Liquid metal loading runner, for example 1430° C.
2.—Loading nozzle.
3.—Storage tank.
4.—Heating inducer (optional).
5.—Pressurisation cap.
6.—Outlet nozzle.
7.—Casts.

8.—Outlet runner.
9.—Stopper.
10.—Plasma torch cathode (optional).
11.—Gas input/output.
g.—Inert gas.
T.—Temperature sensor.
12.—Storage tank, outlet nozzle connection.
13.—Outlet nozzle mouth
b.—Ladle nozzle.

Below an example of a non-limiting practical execution of this invention is described.

The downstream movement of the liquid metal is from the loading runner (1) to the outlet runner (8).

Figure 2:
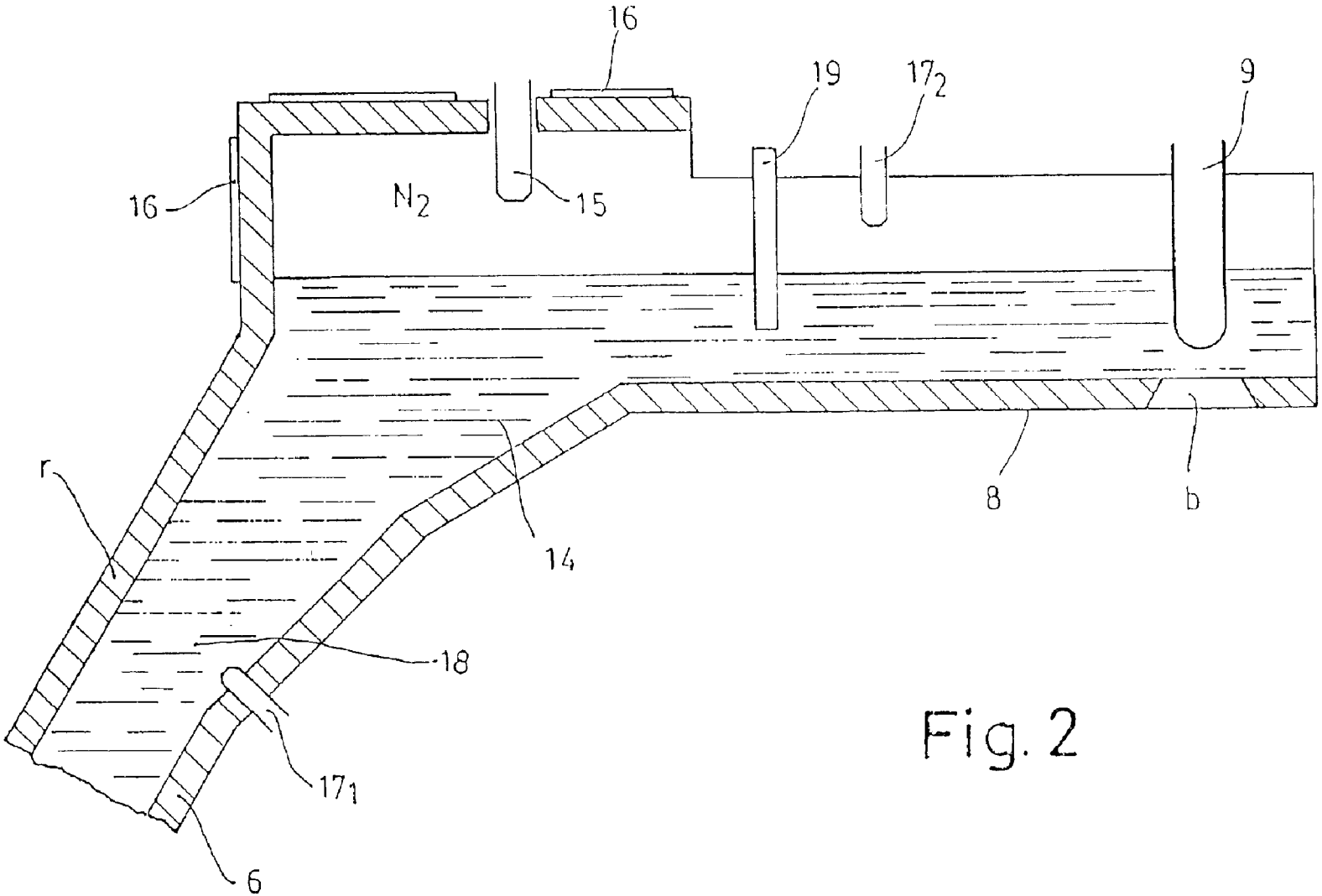
FIG. 2 is a schematic representation of the improvements introduced into a furnace like the one in FIG. 1 and which are the object of the invention.

In the invention there is an additional chamber (14) situated between the connection (12) of the tank (3) with the outlet nozzle (6) and the outlet runner (8), having specified in FIG. 2 that the additional chamber (14) is preferably placed between the outlet mouth of the outlet nozzle (6) and the outlet runner (8).

All of this as usual coating with refractory (r).

A plasma torch cathode (15) is placed in the additional chamber (14) with the traditional raising/lowering means and which acts in inert atmosphere, for example $N_2$.

It also has the relative cooling plates (16).

The anode ($\mathbf{17}_1$) can be placed approximately in the additional chamber, for example in the mouth (18) of the outlet nozzle (6).

As an option, a retaining wall (19) is placed between the additional chamber (14) and the outlet runner (8), with means to raise/lower it.

Normally, the end of the retaining wall (19) will be submerged in the liquid metal, so that the gas used with the plasma, for example $N_2$, does not pass to the outlet runner chamber (8), thus reducing the volumetric needs of this gas. In addition, this retaining wall (19) prevents the passing of slag, which floats on the liquid metal, from the additional chamber (14) to the outlet runner (8), and also prevents the outlet of radiation, screening the plasma are that occurs between the cathode (15) and the liquid metal.

If the retaining wall (19) is used it is advisable to re-locate the anode ($\mathbf{17}_2$) and place it in the area of the outlet runner (8), that is, downstream from this retaining wall (19).

With this positioning of the anode ($\mathbf{17}_2$) the accumulation of slag in it is avoided, and its access, control and replacement in the case of breakdown or wear is facilitated.

In the event of prolonged stoppage, breakdown, etc., if there are heating means, such as inducer (4) and/or plasma (1) or others in the storage tank (3), they can be used to heat the main mass, using the plasma (15) of the additional chamber at discretion.

If both plasmas (10), (15) co-exist, the pressures of their relative inert gases ($N_2$) can be used to cause the liquid metal to run downstream, upstream and make the temperatures constant.

If there are no heating means in the tank, the plasma (15) of the additional chamber (14) and the pressure of its inert gas can perfectly carry out, on its own, the task of heating the metal of the tank (3) forcing the liquid metal to descend from the outlet nozzle (6) and to mix with the metal from the tank (3). This solo function means that the volume of the additional chamber (14) has to be increased, making it approximately between 14 and 21% of the volume of metal that it must heat (in the case of prolonged stoppage).

What is claimed is:

1. In a melt furnace for casting, having a loading nozzle, a liquid metal storage tank connected to the loading nozzle, and an outlet nozzle connected to the liquid metal storage tank that opens out into a feed runner of the casts, the improvement comprising:

an additional heating member chamber placed between the outlet nozzle of the liquid metal storage tank and the feed runner of the casts; and a thermal plasma torch placed in the additional heating chamber capable of instantaneously adjusting the temperature of the liquid metal in the additional heating chamber to correspond to the manufacturing order.

2. The melt furnace for casting according to claim 1, wherein the additional heating chamber has outlet nozzles downstream from an outlet mouth.

3. The melt furnace for casting according to claim 2, further comprising a retaining wall at least partially submerged in the liquid metal between the additional heating chamber and the feed runner of the cast.

4. The melt furnace for casting according to claim 2, wherein an anode of the thermal plasma torch is placed on the walls of the additional heating chamber.

5. The melt furnace for casting according to claim 3, wherein an anode of the thermal plasma torch is placed downstream from the retaining wall.

6. The melt furnace for casting according to claim 3, further comprising means to raise/lower the retaining wall.

7. The melt for casting according to claim 1, wherein the volume (V) of the additional heating chamber is approximately between 14% and 21% of the total volume (Vt) of the furnace $14\% \ Vt \leqq V \leqq 21\% \ Vt$.

8. The melt furnace for casting according to claim 1, wherein the liquid metal storage tank has a heating means, and the volume (V) of the additional heating chamber being approximately between 5% and 10% of the total volume (Vt) of the furnace $\%5 \ Vt \leqq V \leqq 10\% \ Vt$.

* * * * *